US011160150B2

(12) United States Patent
Haines et al.

(10) Patent No.: US 11,160,150 B2
(45) Date of Patent: Oct. 26, 2021

(54) SYSTEM AND METHOD FOR DETECTING A TYPE OF LOAD

(71) Applicant: Pass & Seymour, Inc., Syracuse, NY (US)

(72) Inventors: Joshua P. Haines, Marcellus, NY (US); Anthony M. Testani, Syracuse, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

(21) Appl. No.: 17/119,559

(22) Filed: Dec. 11, 2020

(65) Prior Publication Data

US 2021/0185777 A1 Jun. 17, 2021

Related U.S. Application Data

(60) Provisional application No. 62/947,899, filed on Dec. 13, 2019, provisional application No. 62/961,396, filed on Jan. 15, 2020.

(51) Int. Cl.

| | |
|---|---|
| ***H05B 45/10*** | (2020.01) |
| ***H05B 47/10*** | (2020.01) |
| ***H05B 45/325*** | (2020.01) |

(52) U.S. Cl.

CPC ..... *H05B 45/10* (2020.01); *H05B 45/325* (2020.01); *H05B 47/10* (2020.01)

(58) Field of Classification Search

CPC ..... H05B 45/00; H05B 45/10; H05B 45/32; H05B 45/325; H05B 47/10

See application file for complete search history.

(56) References Cited

U.S. PATENT DOCUMENTS

2012/0262080 A1* 10/2012 Watanabe ..... H05B 45/3725 315/210

* cited by examiner

*Primary Examiner* — Jimmy T Vu

(74) *Attorney, Agent, or Firm* — Bond Schoeneck & King, PLLC; George McGuire

(57) ABSTRACT

A dimmer, including a housing assembly including a plurality of terminals at least partially disposed therein, the plurality of terminals including a line terminal, a neutral terminal, and a load terminal; at least one variable control mechanism coupled to the housing assembly, the at least one variable control mechanism being configured to adjustably select a user adjustable load setting, the user adjustable load setting being adjustable between a minimum setting and a maximum setting; a series pass element disposed in series the line terminal and the load terminal; a sensor producing a sensor output representative of load current at the load terminal; and a controller configured to determine, according to a characteristic of the load current, whether a load connected to the load terminal is a capacitive load, wherein the controller is further configured to, upon determining that the load is a capacitive load, provide sufficient power to the load sufficient to cause the load to illuminate before reducing the power the user adjusted load setting.

30 Claims, 23 Drawing Sheets

FIG. 1C

SYSTEM AND METHOD FOR DETECTING A TYPE OF LOAD

CROSS-REFERENCE TO RELATED APPLICATION

The present application claims priority to and the benefit of U.S. Provisional Patent Application No. 62/947,899, filed on Dec. 13, 2019 and of U.S. Provisional Patent Application No. 62/961,396, filed on Jan. 15, 2020, each of which is hereby incorporated by reference herein in its respective entirety.

BACKGROUND OF THE INVENTION

1. Field of the Invention

The present invention relates generally to electrical dimmers, and more particularly to dimmers that detect a type of load and dim the load accordingly.

2. Description of the Related Art

Some lights, particularly low voltage LEDs, can be dimmed down to very low brightness levels; but do not always illuminate if turned on from a cold start (after the light/bulb has been off for a significant amount of time) or turned off and back on at the low brightness level. Or if they do illuminate, there may be a significant time delay after being switched on by the dimmer before illumination occurs. Furthermore, even though the dimmer senses load current at a low PWM, this is no guarantee that the driver or bulb is producing light output. The dimmer cannot sense light and detecting load current at a low PWM does not necessarily indicate light.

A dimmer can correct this problem by implementing a "burst-energize" algorithm, which turns the bulb on at a sufficiently high voltage so that it illuminates, and then backs the load voltage down to the low brightness level set by the user. Stated differently: If the user sets the dimmer to a low dimming level (i.e., a dimming level for which low-voltage LED bulbs would not illuminate) when the dimming unit is switched from the OFF-state to the ON-state, dimmer output is ramped to near mid-range and then ramped down to the user setting. If the dimming level is above the defined low setting region, then no boost is needed and the dimmer ramps normally to the selected level. The boost is only used to ensure the driver/bulb is fully turned ON (bulb illuminating, at the predefined boost level) and operational before dropping to the low dimmer setting without the light flickering or failing to turn on. The boost mode allows the user to reliably attain the minimum dimming level from power on whether the load was just ON or had been OFF for an extended time.

In one example, when a load is sensed, the dimmer first checks the current dimming level setting and if below, e.g., 32 VAC (2 msec phase control time) (although other voltages and timings may be used), the boost mode is employed. The boost mode starts dimming from a low level and gradually ramps up to a boost dimming level and remains at this level long enough to ensure the driver/bulb is initialized, then gradually ramps down to the current dimmer level setting. Implemented according to this example, the boost dimming appears deliberate and does not result in flashing or a burst of light. Again, boost is only employed at low dimming levels at which certain drivers/bulbs have trouble turning on.

In an example, the load current can be always monitored and if load drops out (that is, current stops flowing), the process is repeated. The capability of such restarts were found to be helpful if the timing/PWM values were not ideal. The load would automatically re-attempt to turn on if the first try failed to stay on at the desired low level. This would typically be the case with a cold start with the driver fully discharged and the dimmer at or below the driver minimum specification. In one example, there is a limit set on repeating the process (e.g., three times), to avoid an endless loop of restarts if the boost is too low. In yet another example, after the three failed attempts to turn the bulb on at the boost level, the process would be repeated, but at an increased boost level, and repeat and increase as needed until the bulb successfully illuminates.

However, many bulbs besides low-voltage LED bulbs do not require such a burst energization start up. For example, tungsten bulbs will illuminate immediately at the same low-voltage that would fail to illuminate the low voltage LED bulb. Applying burst energization to a tungsten bulb, or other bulbs that illuminate at low voltages, will unnecessarily result in an undesirable, and noticeable, bright initial illumination followed by a drop to the dimmed level.

Thus, it is desirable to activate this burst-energize feature only when the dimmer is driving bulbs that require it, i.e. bulbs that have a capacitive reactance signature. Generally, knowledge of the type of load reactance connected to a dimmer allows the dimmer to enact compatible electrical power supply to said load. On one hand, if the load has a capacitive reactance, then there will be inrush current at turn on. The dimmer supplies compatible power by (1) managing this inrush current with softstart ramps or (2) when the desired steady state power level is low, employing burst-energization power to ensure full range load operation (light output).

On the other hand, if the load has an inductive reactance, then there will be, cycle-by-cycle, back EMF voltage transients at semiconductor turn-off due to stored inductor energy. As those skilled in the art will appreciate: forward phase control is appropriate for conventional incandescent lighting, magnetic low voltage (MLV) lighting fixtures, conventional fluorescent lighting fixtures employing electronic ballasts (EFL), and halogen lighting. Reverse phase control is generally appropriate for electronic low voltage (ELV) lighting. Bulbs designed as higher efficiency 120V incandescent replacements, including LED bulbs and compact florescent lights (CFL) typically perform better with forward phase control. The dimmer supplies compatible power by enabling stored inductor energy to continue to flow while interrupting energy from the power source. When the dimmer supplies compatible power to a reactive load, the dimmer and the load are operated within appropriate operating conditions which in turn promotes long life for both circuit components.

BRIEF SUMMARY OF THE INVENTION

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

According to an aspect a dimmer includes: a housing assembly including a plurality of terminals at least partially disposed therein, the plurality of terminals including a line terminal, a neutral terminal, and a load terminal; at least one variable control mechanism coupled to the housing assembly, the at least one variable control mechanism being configured to adjustably select a user adjustable load setting, the user adjustable load setting being adjustable between a minimum setting and a maximum setting; a series pass element disposed in series the line terminal and the load terminal; a sensor producing a sensor output representative of load current at the load terminal; and a controller configured to determine, according to a comparison of a characteristic of the load current to a metric, whether a load connected to the load terminal is a capacitive load, wherein the controller is further configured to, upon determining that the load is a capacitive load, provide sufficient power to the load sufficient to cause the load to illuminate before reducing the power the user adjusted load setting.

For example, the characteristic is an amplitude of a peak the load current resulting from the series pass element turning on, wherein the controller is configured to compare the amplitude of the load current to a threshold.

For example, the threshold is a fixed threshold.

For example, the threshold is a variable threshold.

For example, the controller comprises a comparator, the comparator being in communication with a microcontroller.

For example, the characteristic is a derivative of the load current, wherein the controller is configured to compare the derivative to a threshold.

For example, the derivative of the load current is taken at a point less than or equal to 2 ms following a peak of the load current resulting from the series pass element turning ON.

For example, the derivative of the load current is taken at a point more than 2 ms following the peak of the load current resulting from the series pass element turning ON and before steady state.

For example, the controller comprises a toroid and a microcontroller, the toroid being in communication with the microcontroller.

For example, the characteristic is an integral of the load current taken over an interval following a peak of the load current resulting from the series pass element turning ON, wherein controller is configured to compare the integral to a threshold.

For example, the controller comprises a toroid and a microcontroller, the toroid being in communication with the microcontroller.

For example, the load terminal is a traveler terminal.

For example, the controller comprises a plurality of microcontrollers.

For example, the series pass element comprises a plurality of MOSFETs.

For example, the controller is further configured to determine, according to a second characteristic of the load current, whether a load connected to the load terminal is an inductive load, wherein the controller is further configured to, upon determining that the load is an inductive load, to drive the load according to a dimming sequence that reduces voltage transients at the series pass element.

For example, the second characteristic of the load current is an amplitude of a peak current resulting from turning the series pass element off, wherein the controller is configured to compare the amplitude of the load current to a threshold.

For example, the threshold is a fixed threshold.

For example, the threshold is a variable threshold.

For example, the controller comprises a comparator, the comparator being in communication with a microcontroller.

For example, the characteristic is a derivative of the load current resulting from the series pass element being turned off, wherein the controller is configured to compare the derivative to a threshold.

For example, the controller comprises a toroid and a microcontroller, the toroid being in communication with the microcontroller.

According to another aspect, a dimmer, includes: a housing assembly including a plurality of terminals at least partially disposed therein, the plurality of terminals including a line terminal, a neutral terminal, and a load terminal; at least one variable control mechanism coupled to the housing assembly, the at least one variable control mechanism being configured to adjustably select a user adjustable load setting, the user adjustable load setting being adjustable between a minimum setting and a maximum setting; a series pass element disposed in series the line terminal and the load terminal; a sensor producing a sensor output representative of load current at the load terminal; and a controller configured to determine, according to a comparison of a characteristic of the load current to a metric, whether a load connected to the load terminal is an inductive load, wherein the controller is further configured to, upon determining that the load is an inductive load, to drive the load according to a dimming sequence that reduces voltage transients at the series pass element.

For example, the second characteristic of the load current is an amplitude of a peak current resulting from turning the series pass element off, wherein the controller is configured to compare the amplitude of the load current to a threshold.

For example, the threshold is a fixed threshold.

For example, the threshold is a variable threshold.

For example, the controller comprises a comparator, the comparator being in communication with a microcontroller.

For example, the characteristic is a derivative of the load current resulting from the series pass element being turned off, wherein the controller is configured to compare the derivative to a threshold.

For example, the controller comprises a toroid and a microcontroller, the toroid being in communication with the microcontroller.

These and other aspects of the invention will be apparent from and elucidated with reference to the embodiment(s) described hereinafter.

BRIEF DESCRIPTION OF THE SEVERAL VIEWS OF THE DRAWING(S)

The present invention will be more fully understood and appreciated by reading the following Detailed Description in conjunction with the accompanying drawings. The accompanying drawings illustrate only typical embodiments of the disclosed subject matter and are therefore not to be considered limiting of its scope, for the disclosed subject matter may admit to other equally effective embodiments. Reference is now made briefly to the accompanying drawings, in which.

DETAILED DESCRIPTION OF THE INVENTION

Aspects of the present invention and certain features, advantages, and details thereof, are explained more fully below with reference to the non-limiting examples illustrated in the accompanying drawings. Descriptions of well-known structures are omitted so as not to unnecessarily obscure the invention in detail. It should be understood, however, that the detailed description and the specific non-limiting examples, while indicating aspects of the invention, are given by way of illustration only, and are not by way of limitation. Various substitutions, modifications, additions, and/or arrangements, within the spirit and/or scope of the underlying inventive concepts will be apparent to those skilled in the art from this disclosure. Each non-photographic figure provided and referenced herein includes line drawings, which are numbered, and exact copy color drawings (on the same page) for clarity.

Various examples described herein are directed toward devices and methods of detecting whether a load is a capacitive load or an inductive load and to drive the load accordingly.

Figure 1A:
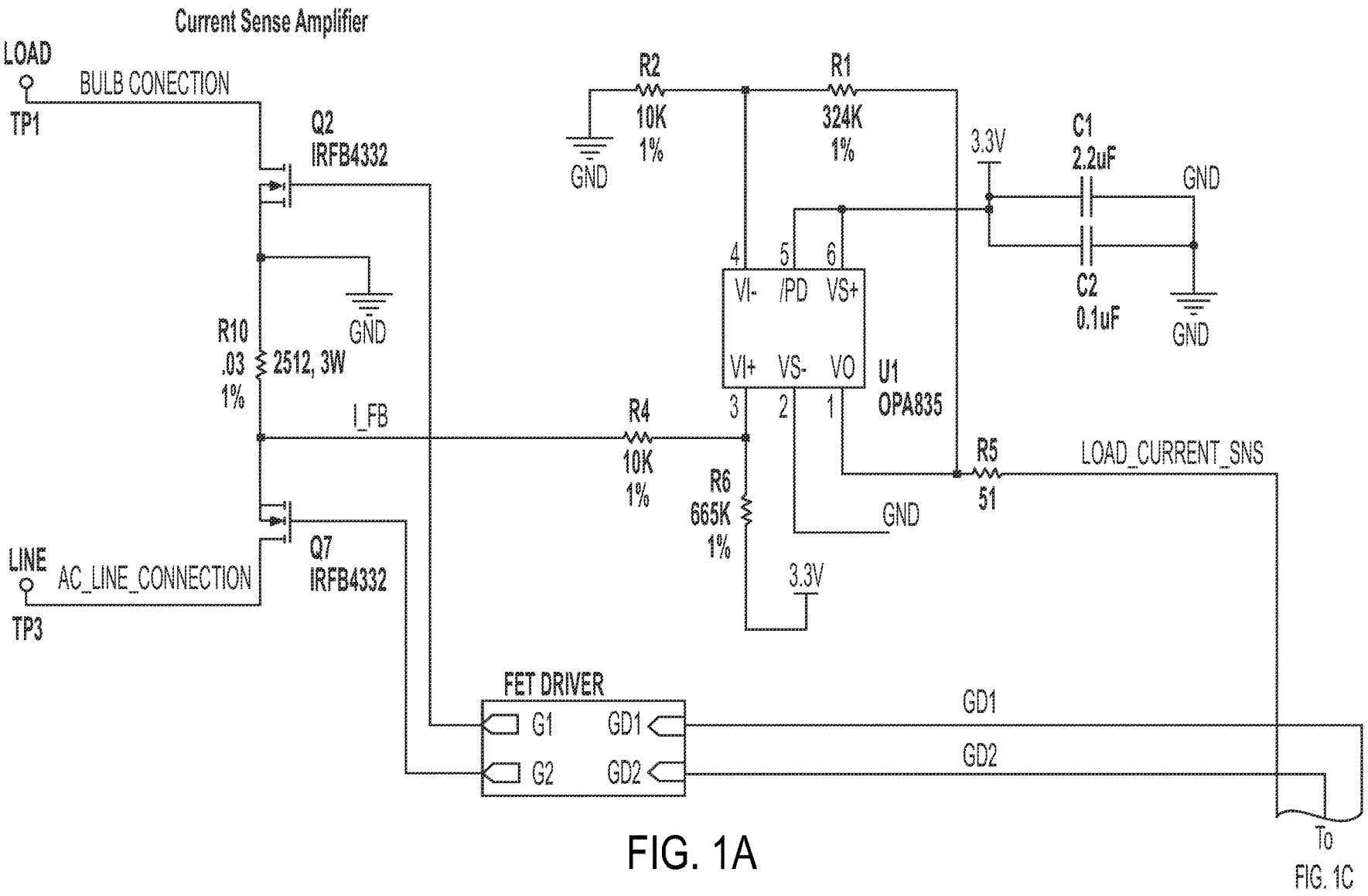
FIG. 1A depicts a circuit schematic of a dimmer, according to an example.
Figure 1B:
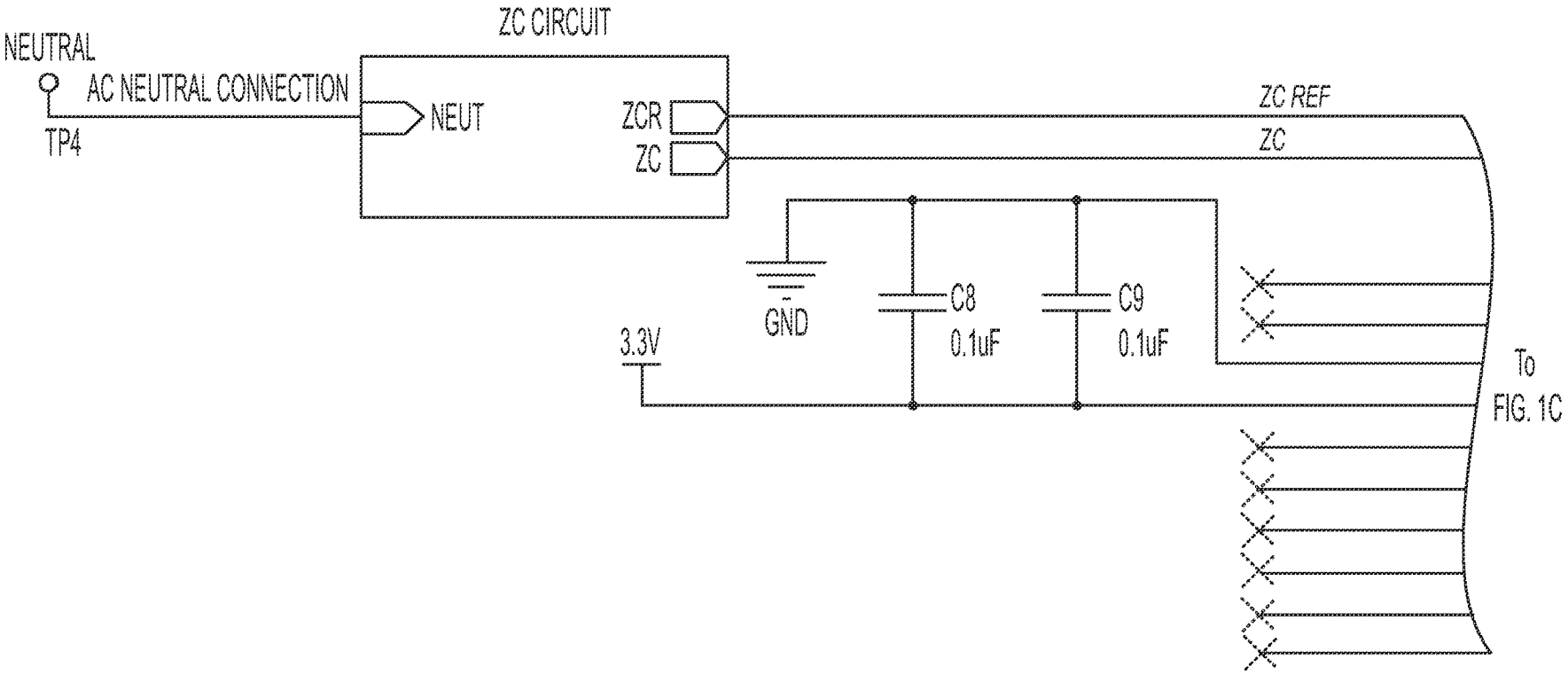
FIG. 1B depicts a circuit schematic of a dimmer, according to an example.
Figure 1C:
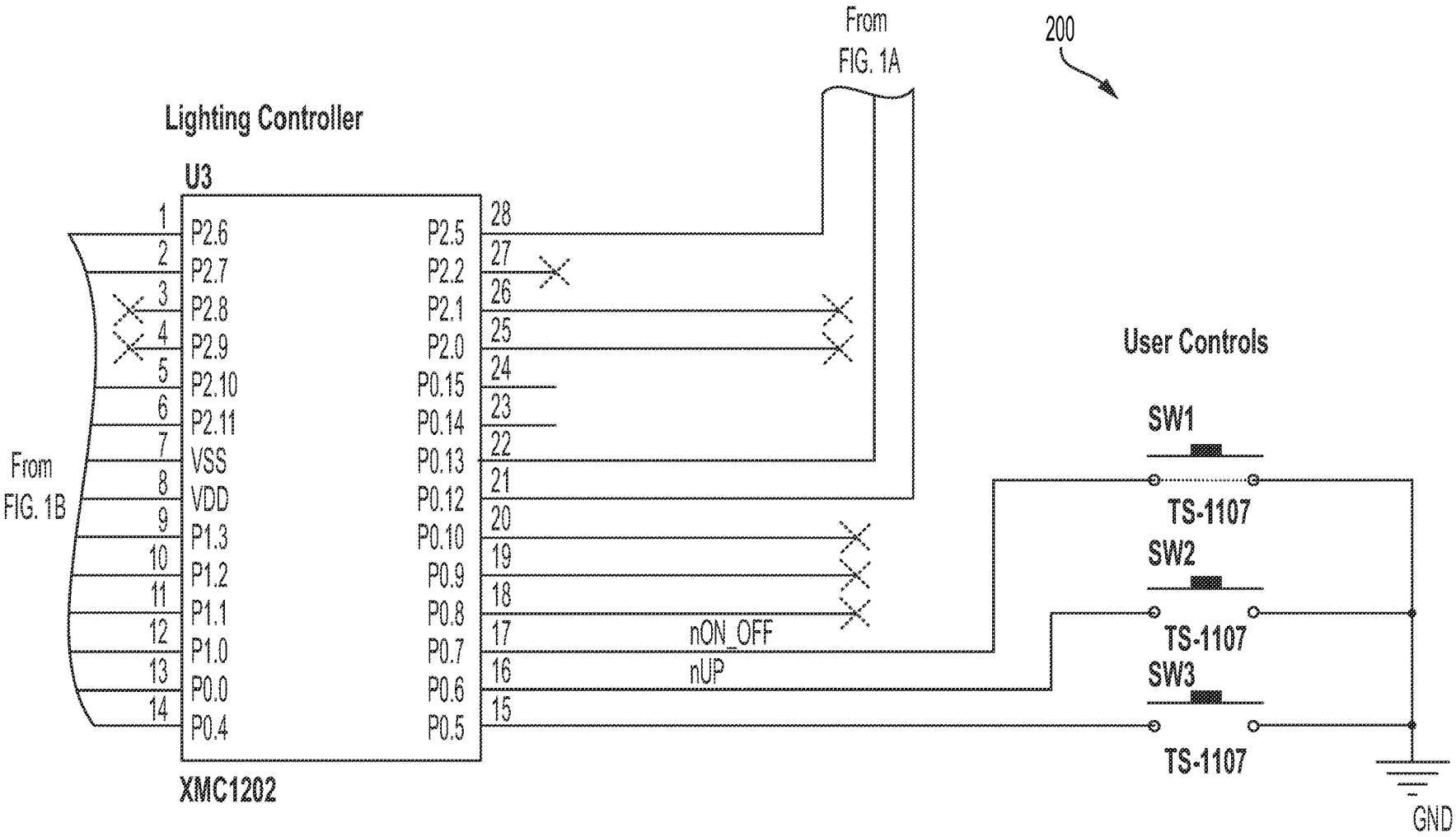
FIG. 1C depicts a circuit schematic of a dimmer, according to an example.

FIGS. 1A-1C depicts a simplified example dimmer 100, capable of identifying the type of load being driven by the dimmer circuit. At a high level, the dimmer 100 identifies a capacitive input characteristic of low voltage LED bulb drivers that may require burst-energization. Although dimmer 100 is provided as an example, any dimmer that includes a controller configured to perform the methods of detecting the type of load according to the methods described in this disclosure and controlling the current provided to the load in accordance with type of load detected, can be used.

The operation of dimmer 100 will be generally understood; however, a brief explanation will be provided for the sake of completeness. The dimmer 100 includes a line terminal TP3, a load terminal TP1, and a neutral terminal TP4. As shown in FIG. 1A, line terminal TP3 is connected to the line conductor from the AC power source and return terminal 28 is connected to either the neutral conductor or the ground conductor returning to the AC power source. In other words, the AC power source is connected across terminals TP3, TP4. The load will be connected across line terminal TP3 and load terminal TP1. In an alternative example, terminal TP3 can comprise a pair of traveler terminals, allowing dimmer 100 to be employed a three-way switch configuration.

Dimmer 100 is an example of a dimmer that conducts power from line terminal TP3 to load terminal TP1 by way of a current sensor (here, resistor R10) and a series pass element (here, MOSFETs Q2 and Q7). Current sensor senses load current and provides a signal to controller U3 which uses that information to identify the load when current is conducting through the load. In the example shown, the sensor is a shunt sensor, although in alternative examples it could be implemented as a Hall Effect sensor, a transformer, or a toroidal transformer. For the toroidal transformer, the conductor to the load passes through its central opening, forming the primary winding. The series pass element restricts power provided to the load in accordance with a control signal from controller U3. In various examples, the series pass element includes solid devices such as a pair of MOSFETs or SCR's connected in series, rectifier diodes, thyristors, triacs, or IGBT's.

Controller U3 controls the dimmer 100 by way of the pulse width modulation (PWM) signal. The PWM signal propagates at logic levels (+3.3V, GND) and controls the operation of the series pass element, which is implemented as transistors Q2 and Q7. The width of the PWM pulse is varied to control the amount of power provided to the load at load terminal TP1. The PWM signal typically comprises at least one pulse in an AC line cycle. In one example, the PWM signal may provide a plurality of pulses within an AC half cycle. By using pulse width modulation, dimmer 100 can be used as universal dimmer device that can control any type of lighting load by varying the duty cycle of the pulse. In operation, when the PWM signal is high, controller U3 turns transistors Q2 and Q7 ON in accordance with the appropriate timing. Note that two transistors (Q2, Q7) are typically required for operation due to the internal body diode inherent in MOSFET technology; one MOSFET blocks a portion of the positive AC half cycle, and the other blocks a portion of the negative half-cycle to the load. The timing of the PWM pulse is controlled by controller U3 and is timed relative to the zero crossing of the AC cycle.

Dimmer 100 can be packaged in a wiring device form factor for installation in a wall outlet box. The wiring device can include one or more power control devices within the device housing. For example, wiring devices that are equipped with both fan motor control and lighting control features are ubiquitous. The exterior of the wiring device includes either screw terminals or wire terminals for subsequent connection between the AC power source and the load. The conventional wiring device form factor also provides a user accessible interface that includes one or more switch mechanisms such as buttons, levers, dials, slide switches, and other such input control mechanisms, connected to the housing, that permit a user to vary the power to a load (between a minimum value and a maximum value) or turn it ON/OFF. In FIG. 1C the user interface is represented as buttons SW1, SW2, and SW3, which function to turn the dimmer ON/OFF, turn power up, and turn power down, respectively.

Dimmer 100 can operate in the forward phase or in the reverse phase. Dimming is accomplished in the forward phase by switching the load current ON sometime after the zero-crossing of the AC half-cycle and turned OFF at the next zero-crossing of the AC waveform. Conversely, in reverse phase control, the load current is turned ON when the zero-crossing is detected and turned OFF sometime before the next zero-crossing is detected. The principle of operation of dimmer 100 is further described in US Patent 9,130,373 and titled "Universal Power Control Device" the entirety of which is incorporated herein by reference. In addition, the dimmers described in the following patents: U.S. Pat. No. 10,476,368 titled "Power control device", U.S. Pat. No. 9,996,096 titled "Power control device with calibration features", and U.S. Pat. No. 9,184,590 titled "Universal power control device," and US 2020/0343722A1 titled "Electrical wiring device with wiring detection and correction" can be used in conjunction with the sensing, wiring configuration determination, and correction, and other features that can be combined in any technically possible way, described in this disclosure (as will be understood by a person of ordinary skill in the in art in conjunction with a review of this disclosure) and are incorporated by reference in their entirety.

Figure 2:
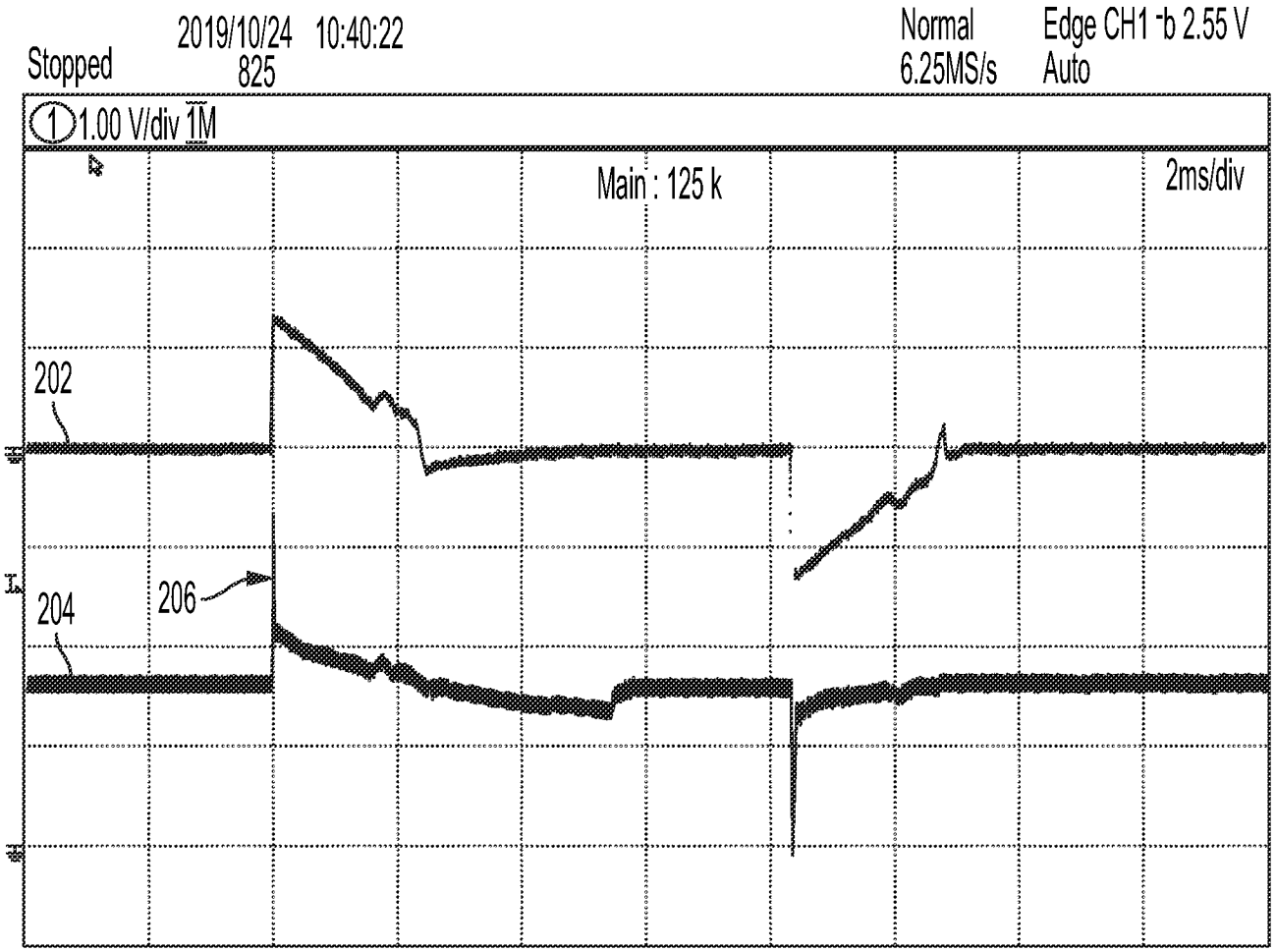
FIG. 2 depicts a load current waveform of a dimmer with a capacitive load, according to an example.
Figure 3:
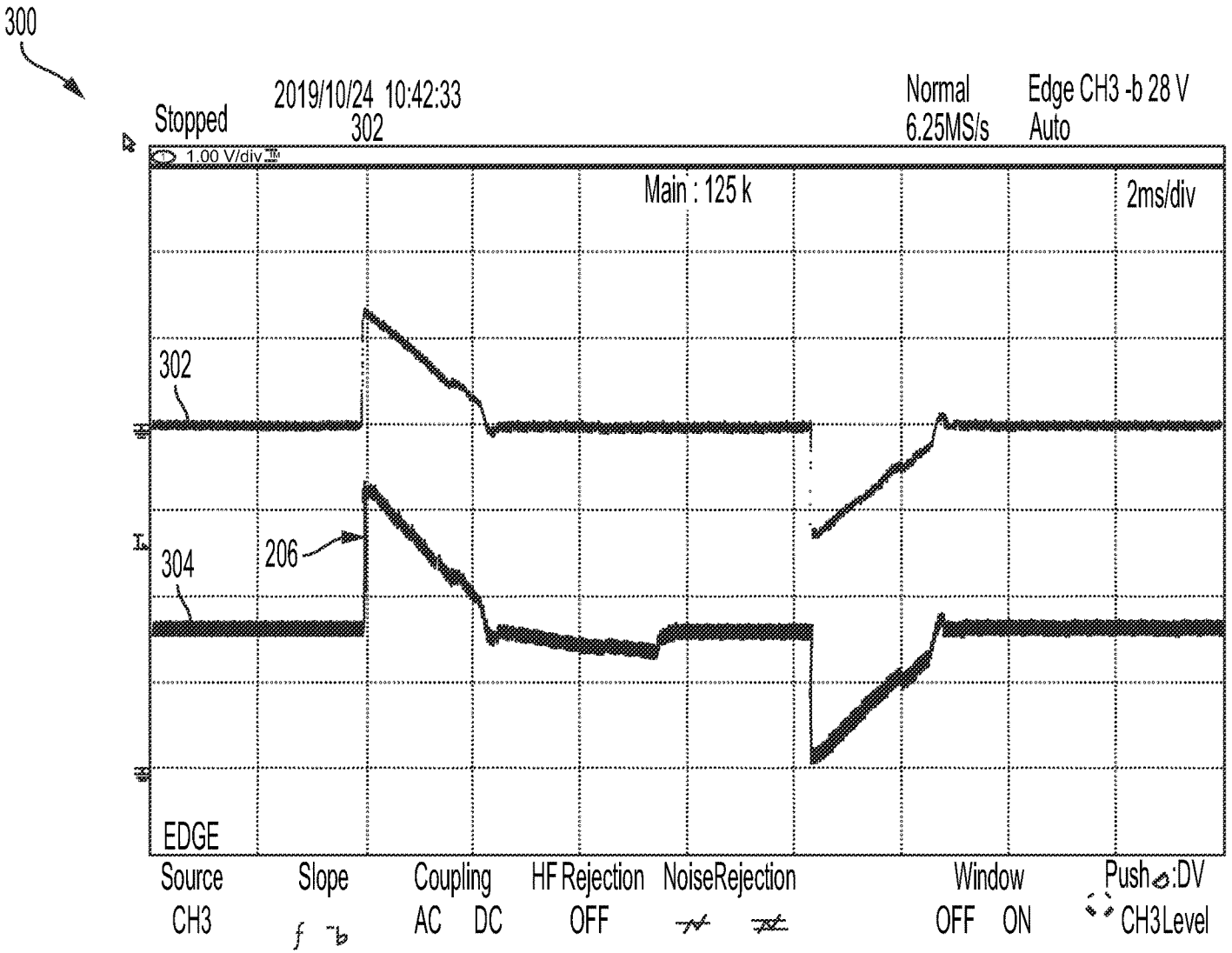
FIG. 3 depicts a load current waveform of a dimmer with a resistive load, according to an example.
Figure 4:
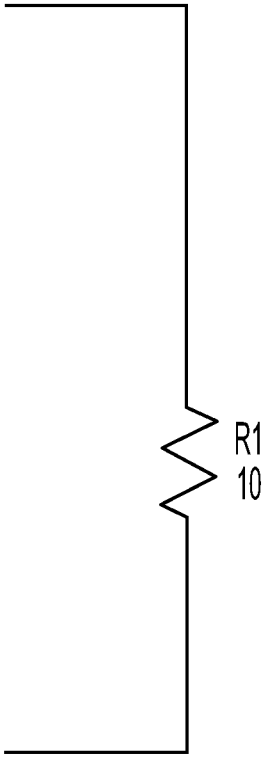
FIG. 4 depicts a schematic of a resistive load.
Figure 5A:
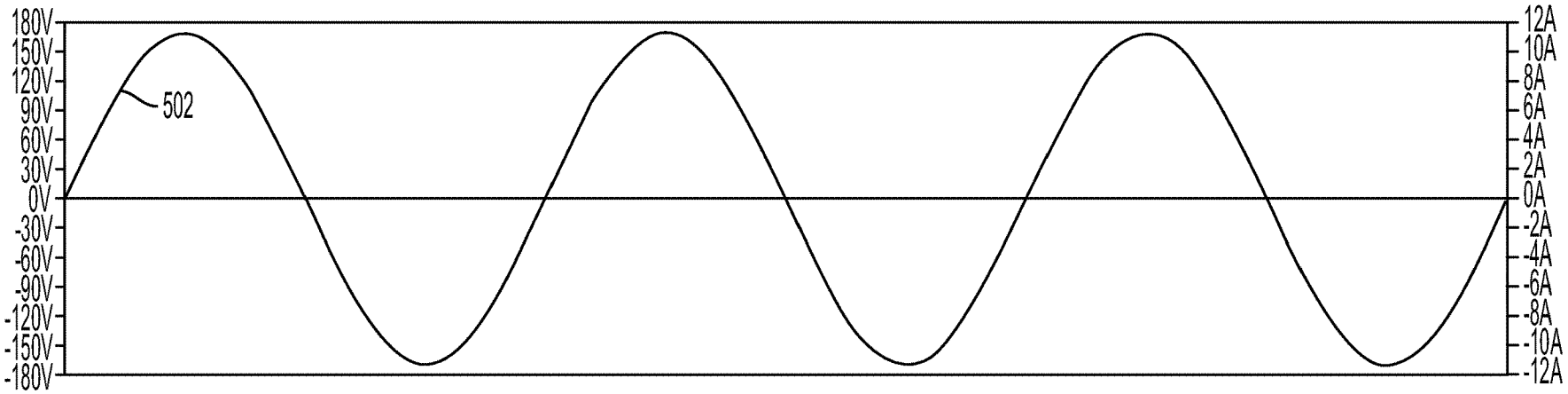
FIG. 5A depicts a line voltage waveform, according to an example.
Figure 5B:
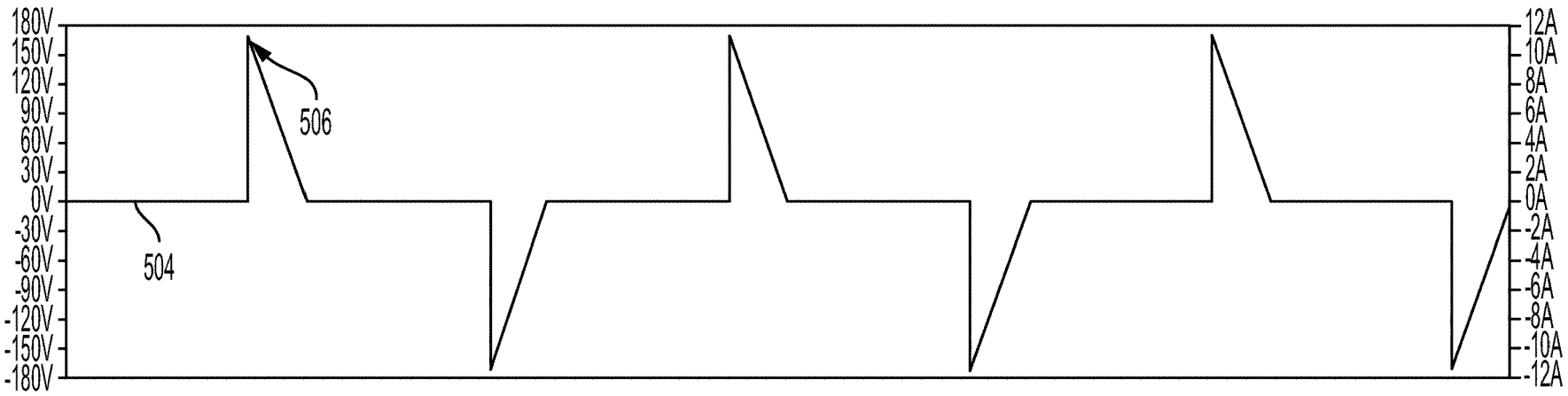
FIG. 5B depicts a load current waveform of a dimmer with a resistive load, according to an example.
Figure 6:
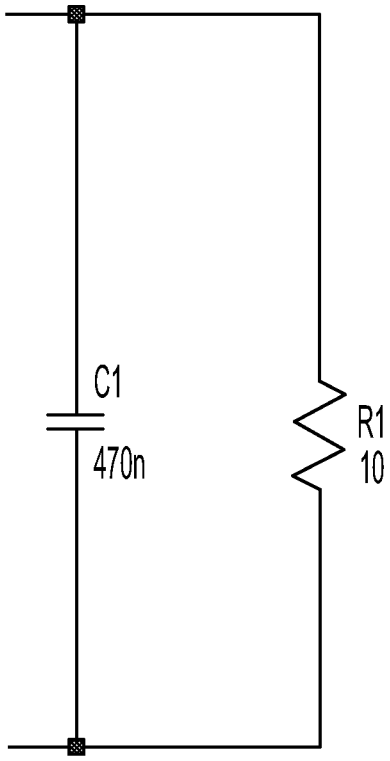
FIG. 6 depicts a schematic model of a capacitive load.

Among other characteristics, the capacitive reactance of an LED bulb results in a current inrush at start up not present in other types of bulbs. This may be shown in FIG. 2, which depicts the voltage (signal 202) and current (signal 204) to a low voltage LED bulb attached to dimmer 100. As shown, at each half-cycle, once the MOSFETs turn ON, there is a sharp spike of current 206—a current inrush—brought on by the capacitive input characteristics of the LED bulb. After the MOSFETs turn ON each half-cycle, the current flows with a sinusoidal waveform similar to the bulb voltage. By contrast, the voltage (signal 302) and current signals (signal 304) of a tungsten bulb, as shown in FIG. 3, have no such current inrush at start up.

To further demonstrate the inrush current as well as back EMF voltage transients, which occur in inductive loads, FIGS. 4-10 depict simulated voltage and current plots associated with various loads. More specifically, FIGS. 5A and 5B depicts the voltage and current plots of a resistive load, such as a tungsten bulb, modeled as R1 in FIG. 4. FIG. 5A depicts the line voltage 502 (i.e., the AC waveform applied at the line and neutral terminals) and 5B depicts the load current 504 when attached to this resistive load. Similarly, FIG. 7A shows the line voltage waveform 702 and the load voltage 704 for a capacitive load, such as an LED bulb, modeled as the parallel combination of R1 and C1 in FIG. 6. FIG. 9A depicts the line voltage waveform 902 and the load current 904 for an inductive load, modeled as inductor L1 in FIG. 8. In additional, FIG. 9C shows the back EMF transients 906. FIG. 10A-10C depicts the same waveforms of FIG. 9C, but with the MLV dimming scheme employed.

Returning to FIG. 1A, in this example, the load current is measured at current sense resistor R10. Specifically, current through the bulb flows through R10, creating a voltage on the I_FB net that is symmetrical around the Ground net. Specifically, as the AC current flows through the load and the FETs, it creates a positive or negative voltage on the I_FB node. Thus, when TP1 is positive and TP3 is negative, I_FB produces a negative voltage. When TP3 is positive and TP1 is negative, I_FB produces a positive voltage. It should, however, be understood that the current to the load can be measured at any location, and in any way suitable, for detecting the inrush current.

In this example, the I_FB signal which is initially biased below the lower half portion of the 3.3V supply range, is shifted and amplified by U1 to the middle of the 3.3V supply voltage range. U3, which, as will be described below, ultimately measures the nature of the inrush current. U1, as shown in FIG. 1A, is a fast op amp in order to quickly adapt to the detected inrush current. The nature of, including the type, gain, and voltage shift, as well as the necessity of, the amplifier used depends on the input requirements of controller U3. Thus, it should be understood that, in alternative examples, a different amplifier or no amplifier may be used, according to the input requirements of controller U3.

As shown in FIGS. 1A-1C, the output of U1 (designated as LOAD_CURRENT_SNS in FIG. 1A) is monitored by controller U3 using its internal analog-to-digital converter in order to detect a low-voltage LED bulb according to the characteristics of the load current. It should be understood that the controller U3 can be any device, e.g., a microcontroller, having a processor suitable for detecting the inrush current according to the methods described in this disclosure. Furthermore, controller U3 can include a non-transitory storage medium storing program code for executing the described in the methods described in this disclosure. In addition, controller U3 can be implemented as a combination of one or more microcontrollers acting in concert or as a combination of one or more microcontrollers and associated hardware (e.g., resistors, capacitors, or other electrical components that configure or otherwise aid the operation of the microcontroller(s)), together carrying out the functions described in this disclosure.

FIGS. 11A-11D depict a flowchart of a method 1100 for detecting the type of load to which a dimmer supplies current and for adjusting the output of the dimmer in accordance with the type of load detected. The dimmer can be any type of dimmer, such as dimmer 100, suitable for carrying out the steps of method 1100. More particularly, the steps of method 1100 can be performed by a controller, such as controller U3, having a processor and a non-transitory storage medium storing program code that, when executed by the processor, carries out the steps of method 1100. As described above in connection with controller U3, the controller can include a microcontroller, or multiple microcontrollers, and any associated hardware.

At step 1102, a test current is supplied to the load. This test current need only be sufficient to detect the characteristics of the load current relied upon below to determine the type of load. It need not be sufficient to cause the load to illuminate; indeed, in certain examples, the current supplied to the load can be low enough that most or all types of loads will fail to perceptibly illuminate. As described in connection with dimmer 100, the test current can be supplied to the load the by sending a pulse-width modulated signal (from the controller) to a series pass element, although other methods of supplying the test current are contemplated.

At step 1104, a characteristic of the load current is compared to a metric to determine the type of load. This step can be performed in any number of suitable ways and any number of suitable characteristics and metrics can be used. Some example characteristics include the amplitude of load current (i.e., the inrush current peak), the derivative of the load current, and the integral of the load current. The methods of comparing these various characteristics is present are discussed in more detail in connection with FIGS. 11B-11D.

This step assumes that the characteristic of the load current is known, which requires a sensor positioned to detect the relevant characteristic of the load current. In certain examples, the sensor can include a resistor—such as resistor R10 shown in FIG. 1A—positioned to create a voltage proportional to the load current. In alternative examples, as appropriate, the sensor can be a toroid sensor positioned to detect the derivative of the load current, e.g., in an encircling relation to the load terminal TP1. Other suitable types of sensors (e.g., a Hall Effect sensor) can be used in various alternative examples.

Figure 11A:
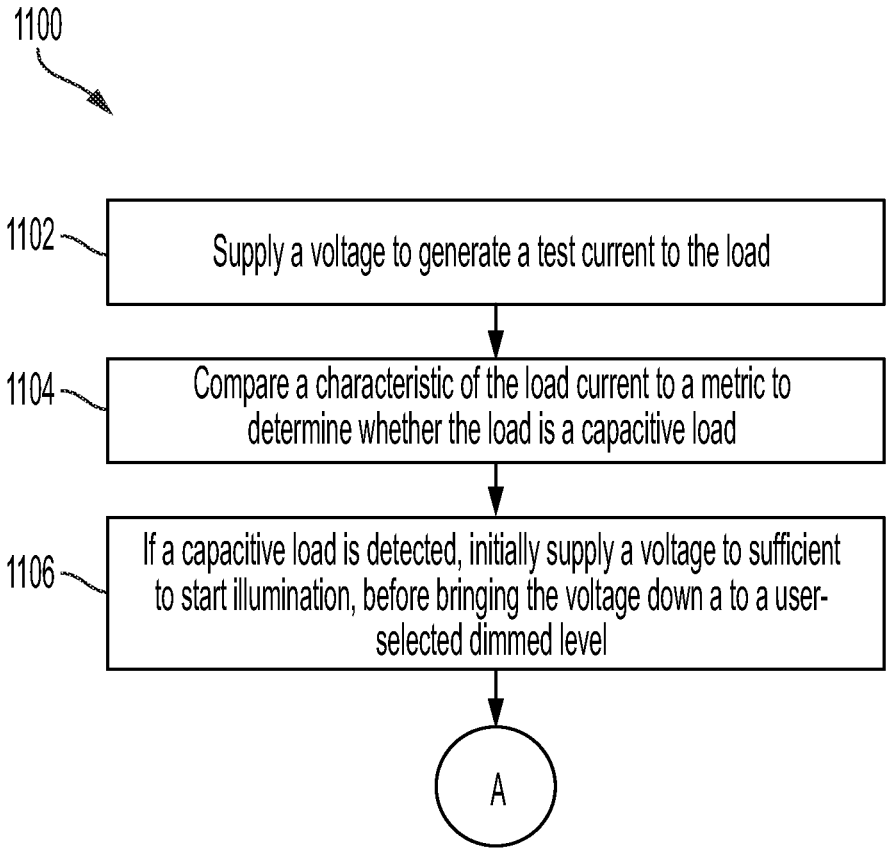
FIG. 11A is a flowchart of a method for detecting a type of load, according to an example.
Figure 11B:
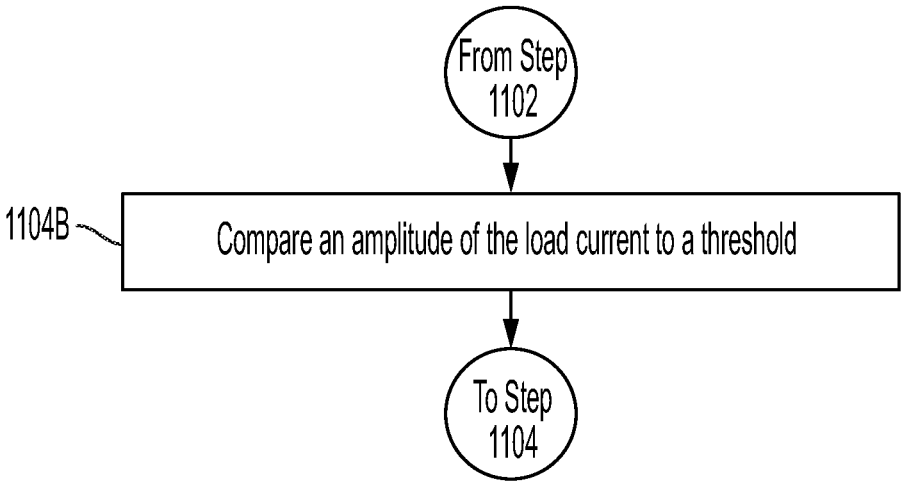
FIG. 11B is a flowchart of a method for detecting a type of load, according to an example.

Turning to FIG. 11B, there is shown an example of step 1104, in which the amplitude of a load current is used as the metric for detecting the presence of inrush current. In this manner, the peak current resulting from the series pass element turning on can be compared to a threshold to determine whether the peak current is indicative of inrush current and, consequently, a capacitive load. The peak of the inrush current spike is typically higher than the peak current for other load types, as can be seen by comparing the current peaks in FIGS. 5B (approximately 12 A), 7B (approximately 18 A), and 9B (approximately 5 A). Thus, in this example, by setting a current threshold above 12 A and below 18 A (these values are provided only as examples), capacitive loads can be detected.

The comparison can be performed by a comparator internal to a microcontroller of the controller receiving an output from a current sensor (e.g., resistor R10); however, in alternative examples, the comparison can be performed by an analog comparator (e.g., using an op amp topology) the output of which is in communication with the microcontroller. For the purposes of this disclosure, "in communication with" means that the output is input either directly or indirectly connected (via one or more intervening components) to the microcontroller.

The threshold against which the current amplitude is measured can be a fixed threshold (such as the threshold described above) or a variable threshold determined during runtime. As an example of a variable threshold, the threshold can be some predetermined value greater than the measured steady-state current or average steady-state current (averaged over multiple cycles or over a particular cycle or over a part of a cycle).

In order to determine the steady state, controller U3 can measure the time derivative of current with respect to time (i.e., di/dt) of the input with respect to U1. Because the derivative of a inrush current will be very high with respect to steady state, the steady state can be distinguished from the current spike by measuring the relative differences in the derivative over time (by contrast, the time derivative of the current of a tungsten bulb will remain relatively constant over the half-cycle as the load current of the tungsten bulb generally follows a sinusoid). This can be accomplished in a number of ways, such as by comparing the highest derivative of the current with respect to the average derivative of the current over a half-cycle or by comparing the minimum derivative of the current with respect the maximum derivative of the current over a half-cycle. Alternatively, because the locations of the inrush current are predictably situated in time with respect to the operation of the series pass element, the steady state current can be taken as the current value(s) as some predetermined time or interval after the operation of the series pass element.

In an alternative example, rather than measuring the derivative of the current, the steady-state of the current can be assumed during pre-specified portions of the half-cycle. For example, the maximum current during the first half of the half-cycle can be measured against the maximum current in the second half of the half-cycle. If the maximum current in the first half is greater than the maximum current in the second half by some predetermined amount or by some multiple, the load can be determined to have a capacitive input characteristic. Or, depending on the timing of the operation of the series pass element, if the maximum current in the second half is greater than the maximum current in the first half by some predetermined amount or some multiple, the load can be determined to have capacitive input characteristics.

In yet another example, the signal at any point in the cycle may be compared against a sine wave reference signal. A tungsten bulb, for example, will follow the sine wave of the line voltage after the series pass element turn on. Thus, by comparing the signal to a sine wave reference, a transient may be detected when the magnitude of the signal exceeds the sine wave reference by some predetermined amount. This is tantamount to comparing the load current waveform to a plurality of thresholds, each threshold designed to measure whether the load current deviates from an expected value (as informed by a sinusoid mirroring the line voltage) some predetermined point in the half cycle.

Figure 7A:
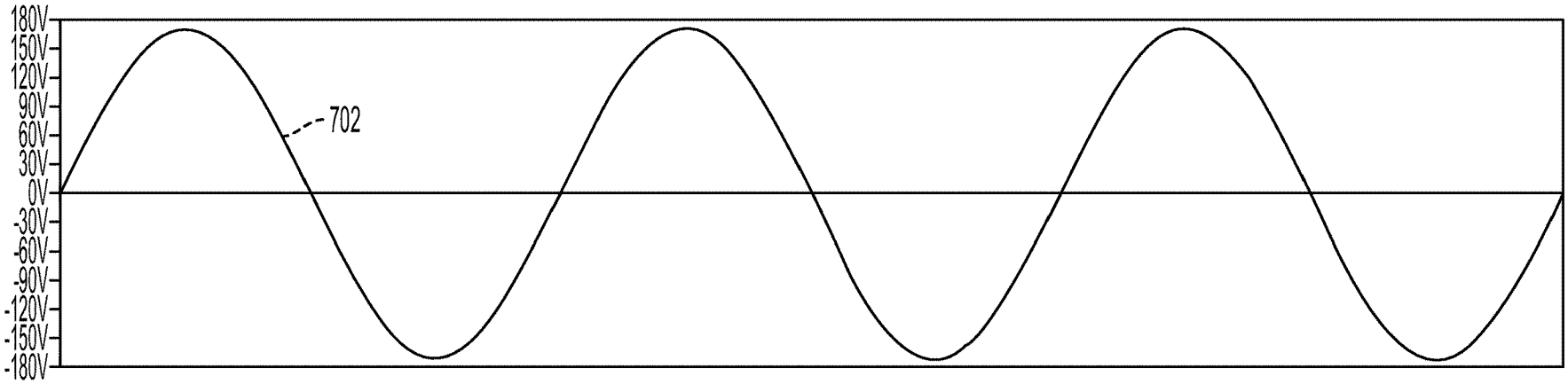
FIG. 7A depicts a line voltage waveform, according to an example.
Figure 7B:
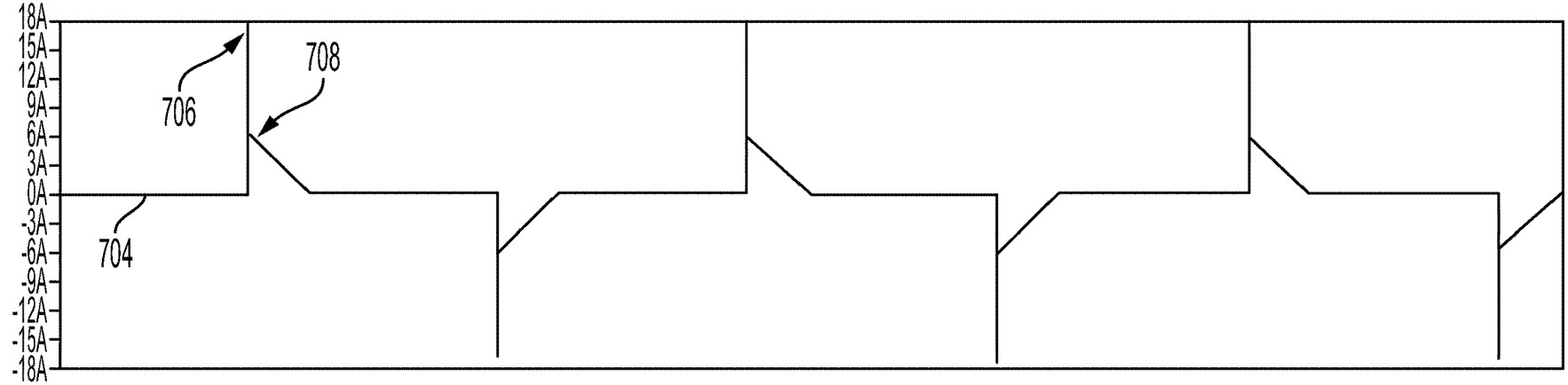
FIG. 7B depicts a load current waveform of a dimmer with a capacitive load, according to an example.
Figure 8:
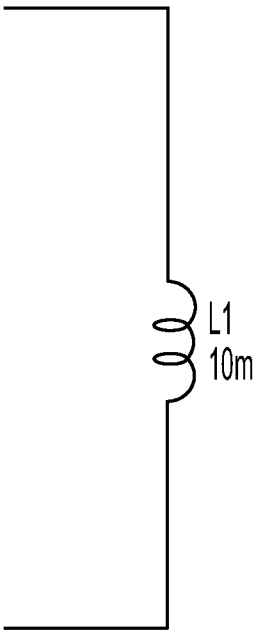
FIG. 8 depicts a schematic model of an inductive load.
Figure 11C:
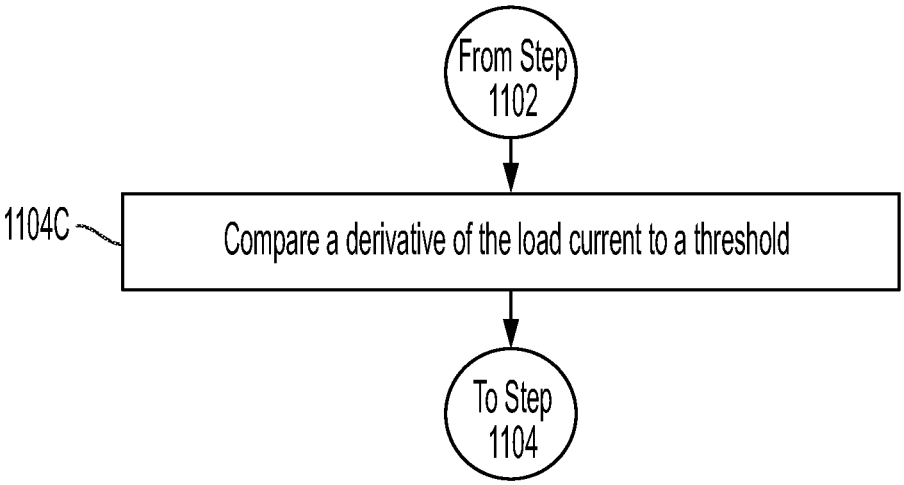
FIG. 11C is a flowchart of a method for detecting a type of load, according to an example.

In the second example, shown in FIG. 11C as step 1104C, the time derivative of the current can be employed as a metric to determine the presence of a capacitive load. A current spike is distinguishable by its rapid increase and rapid decrease, as can be seen in FIG. 7B where the slope to the left and right of the peak 706 is very steep. By contrast, while a tungsten bulb will similarly rapidly increase following the series pass element turn on, it will decrease slower, following the voltage applied to it (see, for example, FIG. 5B, which, following peak 506, descends slower than the decrease immediately following peak 706). An inductive load will likewise decrease more slowly directly following the peak current. Thus, comparing the derivative of the current to a threshold, directly after the initial increase can reveal the presence of inrush current. This can be accomplished in multiple possible ways.

Most directly, the derivative of the sharp decrease can be directly measured. This decrease will have a relatively high negative derivative and can be compared to a negative threshold value. If the derivative of the sample(s) immediately following the sharp increase (i.e., within 2 ms of the current peak) exceeds a negative threshold value set to capture the falling edge of the inrush current spike, it can be determined that the load is capacitive.

Alternatively, the current at a point following the sharp decrease of the inrush spike (typically more than 2 ms after the initial increase), in a capacitive load, will decrease slowly compared to the current of a resistive load or an inductive load. For example, the slope beginning at the point of FIG. 7B denoted as 708 exhibits a slope that is not as steep as the slope following peak 506 of FIG. 5B or of peak 908 of FIG. 9B. The threshold can therefore be set a predetermined negative value, which is set above the expected decrease in a resistive load but below the expected decrease in a capacitive load.

The derivative of the current, as measured either in step 1104B or 1104C, can be taken, for example, either using a microcontroller of the controller or by associated hardware, such as with a toroid disposed to detect the derivative of the current to the load, the output of which is in communication with a microcontroller.

Figure 11D:
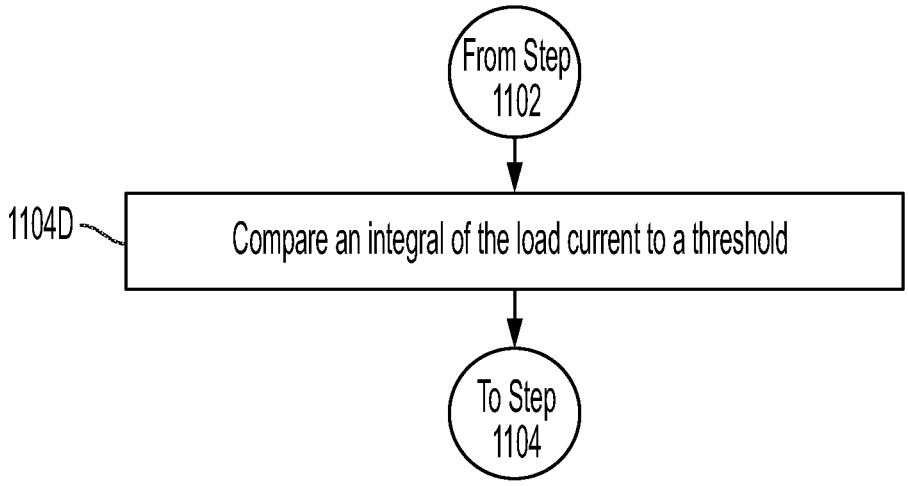
FIG. 11D is a flowchart of a method for detecting a type of load, according to an example.

In a third example, shown in FIG. 11D as step 1104D, a capacitive load can be found from the integral of the current following the initial increase after series pass element turn on. This step is the corollary to step 1104C and builds on the nature of the shape of the current waveform after the initial increase. After the initial increase, the area under the curve of the current waveform for capacitive loads is substantially less than the area under the curve of resistive or inductive loads. This can be seen by comparing the areas under the current waveform from point 708 in FIG. 7B to the area under the curves after point 506 of FIG. 5B or of point 908 of FIG. 9B. Accordingly, by integrating each waveform over an interval after the initial peak value, and comparing this value to a threshold, it can be determined whether the integral is indicative of a capacitive load or otherwise. In an example, the interval is the duration for which the series pass element is ON, however, shorter or longer intervals can be used.

The integral can be found, for example, by performing the integration internally within a microcontroller of the controller, or by associated hardware, such as an integration circuit (as such are known in the art), the output of which is communication with the microcontroller.

If at step 1104 inrush current is detected, then at step 1106, the controller can drive the load in accordance with the burst energization algorithm—that is, by initially turning the bulb ON at a voltage sufficient to start illumination, before bringing the bulb down to a dimmed level selected by a user or some default value. (This assumes that the user selected dim value or the default value are below the minimum voltage required to initially illuminate a capacitive load.) If, however, the inrush current is not detected, controller can turn the bulb on at a voltage lower than the voltage necessary to turn on a low-voltage LED bulb, if such a voltage has been selected by a user, or at some default value.

In certain examples, more than one method for detecting inrush current can be implemented in order to detect the presence of a capacitive load. For example, the amplitude of the current can be compared to a threshold and a derivative of the current can be compared to a threshold. If one or both (depending on the level of sensitivity desired) metrics are indicative of inrush current, it can be determined that the load is capacitive.

Figure 9A:
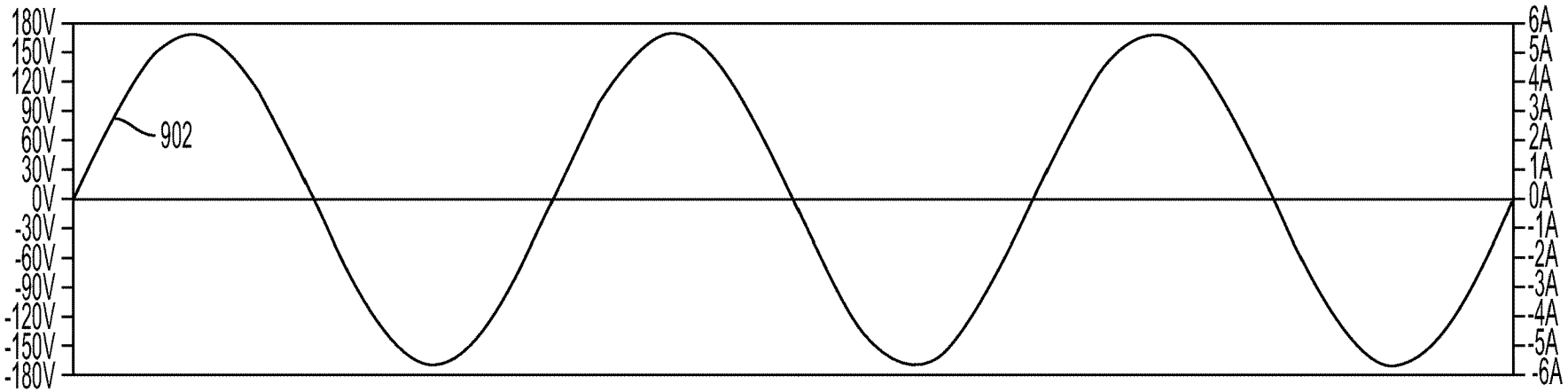
FIG. 9A depicts a line voltage waveform, according to an example.
Figure 9B:
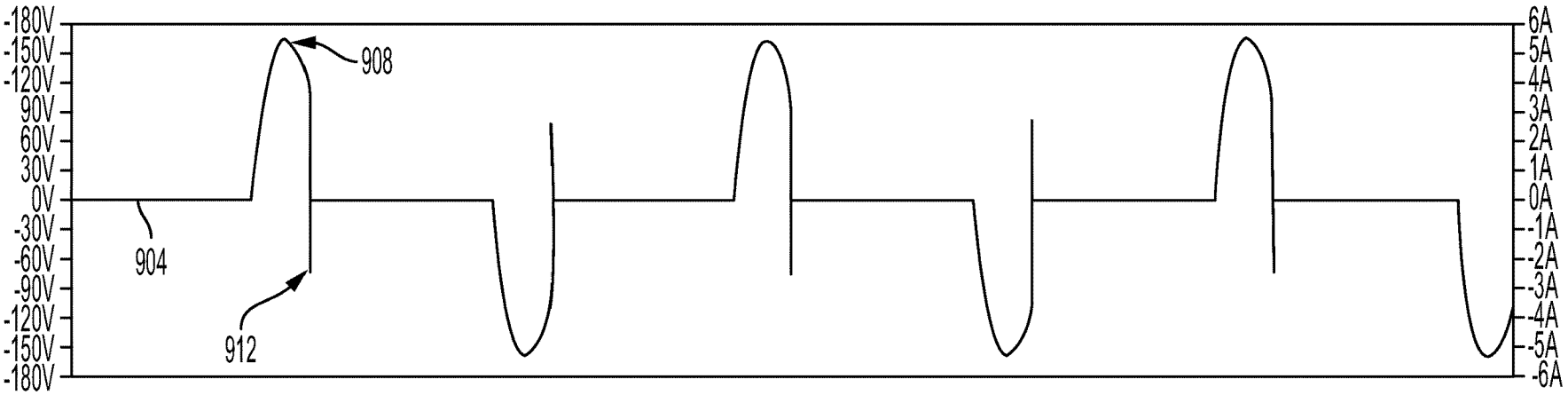
FIG. 9B depicts a load current waveform of a dimmer with an inductive load, according to an example.
Figure 9C:
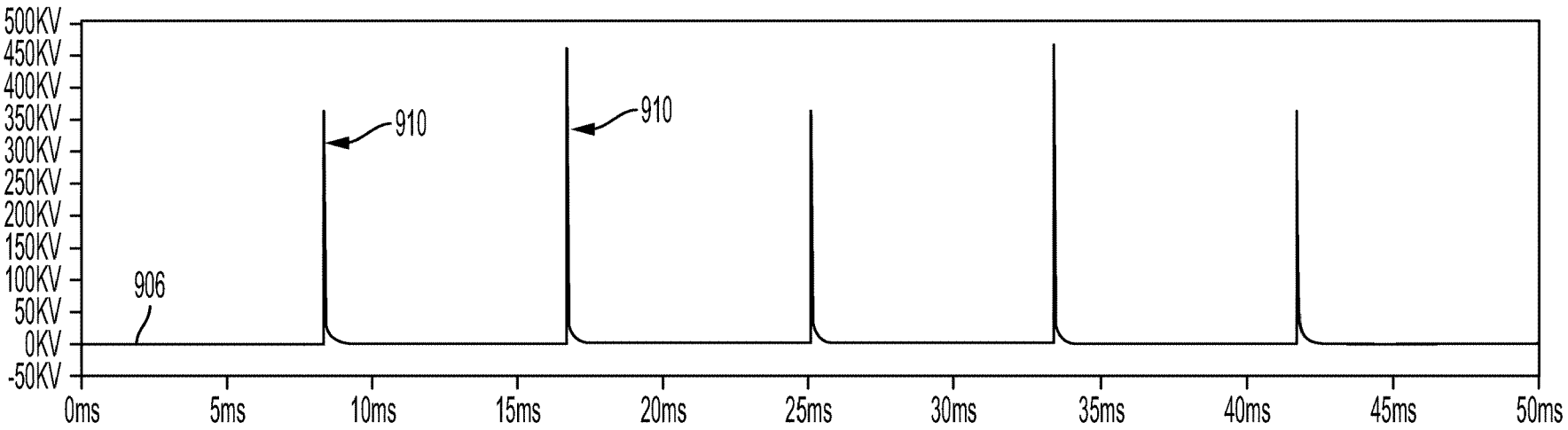
FIG. 9C depicts a voltage waveform at a series pass element of a dimmer, according to an example.
Figure 10A:
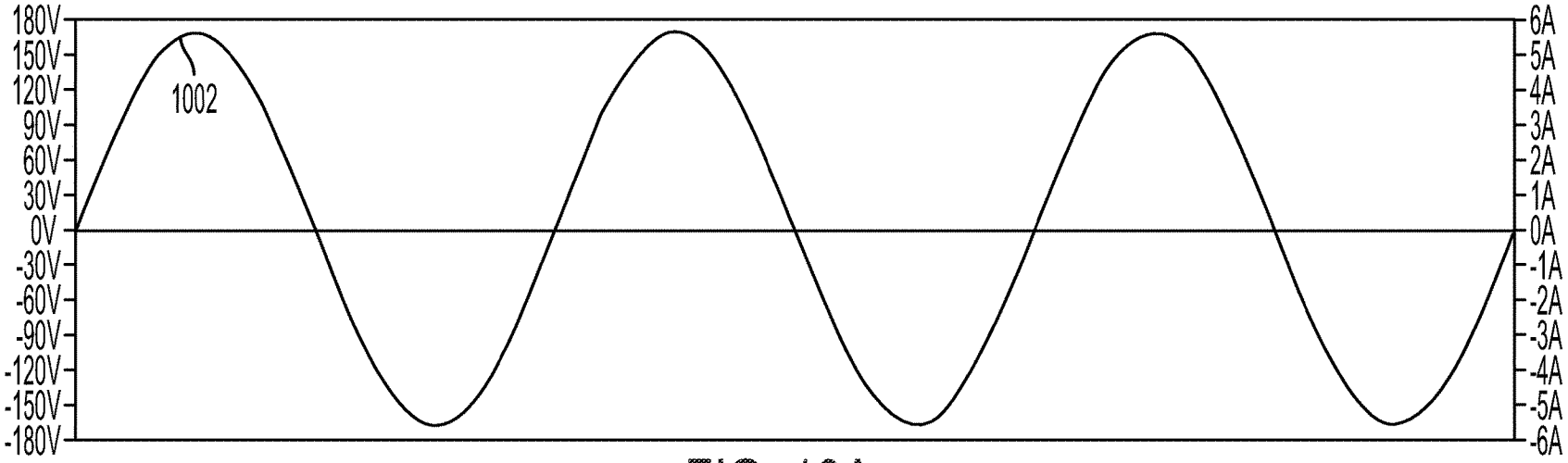
FIG. 10A depicts a line voltage waveform, according to an example.
Figure 10B:
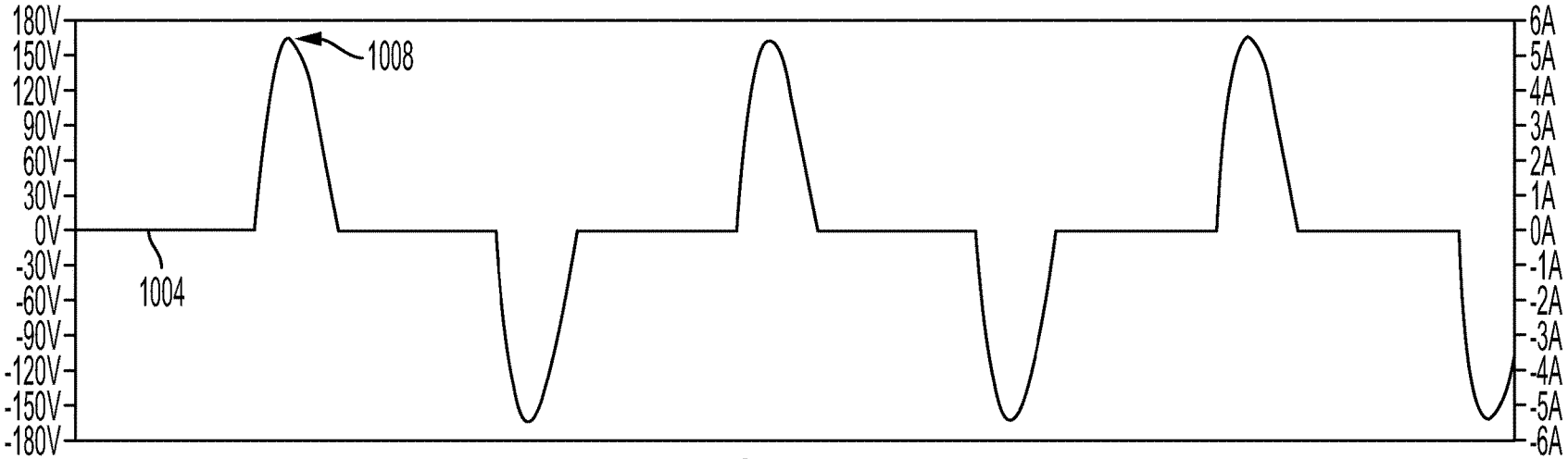
FIG. 10B depicts a load current waveform with an inductive load, according to an example.
Figure 10C:
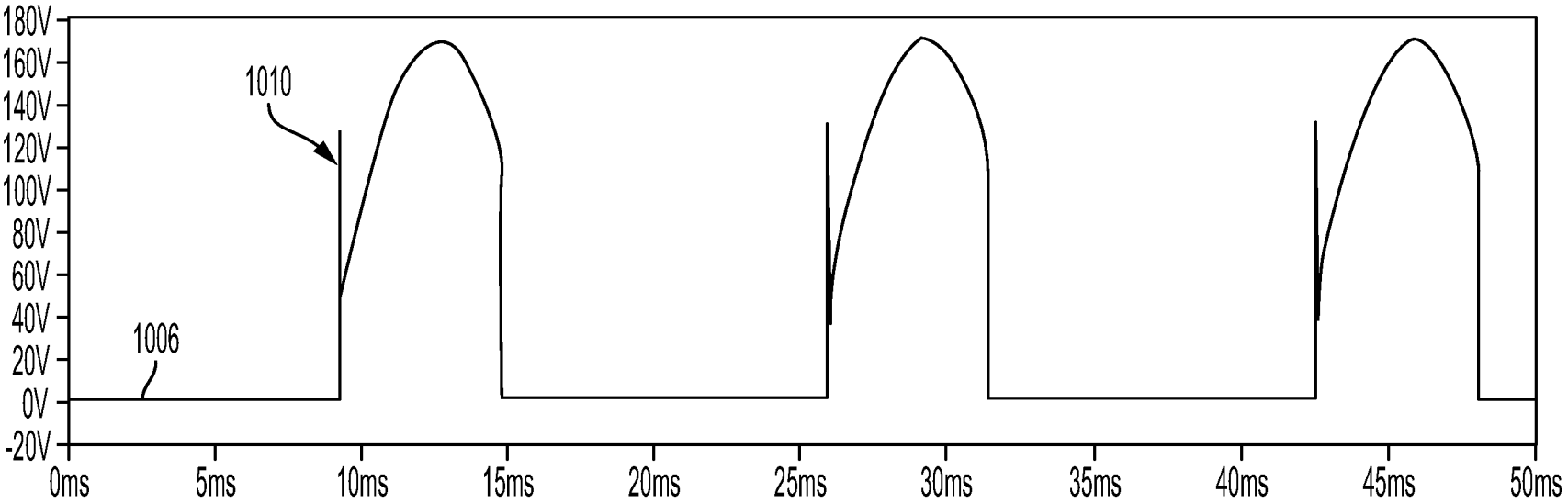
FIG. 10C depicts a voltage waveform at a series pass element of a dimmer, according to an example.

As described above, when an inductive load is used, a back EMF transient (examples of which are shown in FIG. 9C, denoted as 910) will form when the series pass element interrupts current flow. The back EMF transient is enough to cause an overvoltage failure in the semiconductors, depending on the load's inductance. To address this transient, a turn-off sequence, described herein as 'MLV mode' has been developed where the reverse biased semiconductor remains in conduction allowing uninterrupted current flow through the inductive load until the stored energy is consumed. Explicitly stated, in the example of FIG. 1A, the reverse-biased semiconductor is the line side FET in forward current and load side FET in reverse current. When MLV mode is employed by the dimmer, the transient is therefore suppressed to little more than peak line voltage (max), as shown in FIG. 10C as transients 1010. This mode is described in more detail in U.S. Pat. No. 10,476,368.

At step 1108, it is determined whether a turn-off current transient is present in the current supplied to the load by measuring a characteristic of the load current, resulting from the turn off of the series pass element, to a metric. Step 1108 can be carried out using some of the methods for detecting inrush current, adapted to detect a turn-off current transient instead of a turn-on current transient (i.e., inrush current).

Figure 11E:
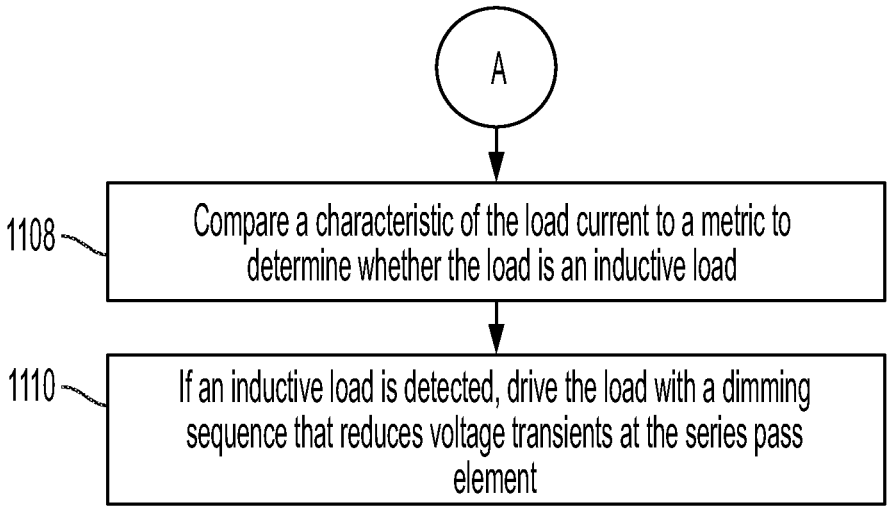
FIG. 11E is a flowchart of a method for detecting a type of load, according to an example.
Figure 11F:
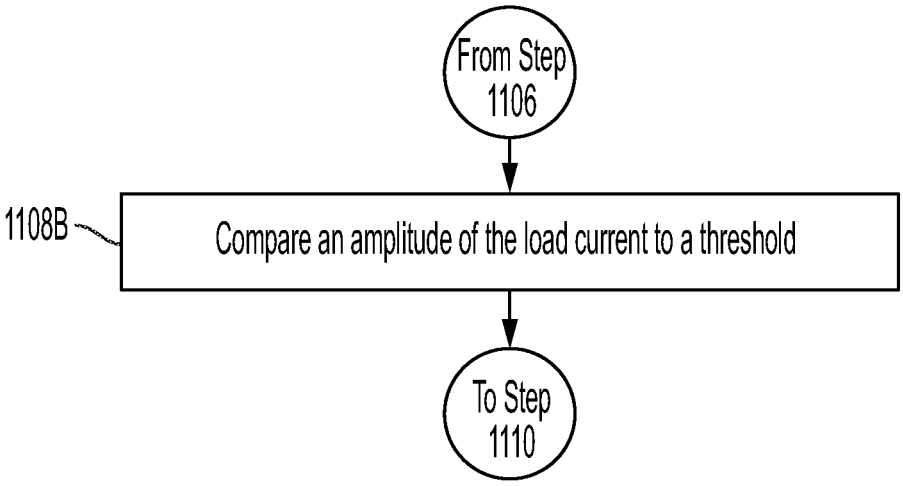
FIG. 11F is a flowchart of a method for detecting a type of load, according to an example.

For example, as described above, an inductive load creates transients at turn off of the series pass element. Thus, as shown in FIG. 11E at step 1108B, turn-off current transients can be measured by comparing the current to the threshold directly after the turn off (e.g., within 2 ms of turn off). If the current exceeds the threshold, the turn-off current transient is identified.

As described above in connection with FIG. 1104B, the threshold against which the amplitude is measured can be a variable or fixed threshold. Further, the comparison can be performed by a comparator internal to a microcontroller of the controller receiving an output from a current sensor (e.g., resistor R10); however, in alternative examples, the comparison can be performed by an analog comparator (e.g., using an op amp topology) the output of which is in communication with the microcontroller.

Figure 11G:
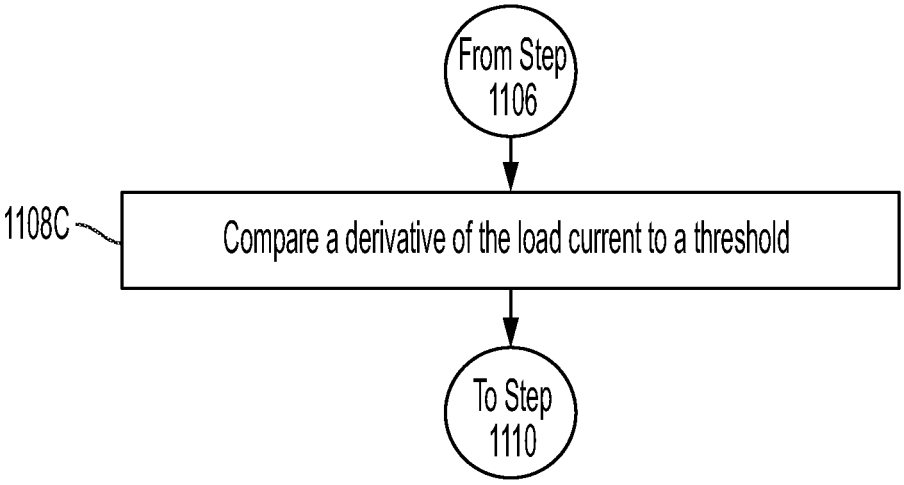
FIG. 11G is a flowchart of a method for detecting a type of load, according to an example.

Further, as shown in FIG. 11G, at step 1108C, the derivative of the current following the turn off (e.g., within 2 ms of turn off) can be measured and compared to a threshold to determine whether it falls below the negative derivative value expected for an inductive load. The derivative of the current at the turn off, with an inductive load, will be a lower negative value than that of either a resistive load or a capacitive load (both of which feature a shallower slope downward after the turn off and no current following the zero cross, as can be seen comparing FIG. 9B to FIG. 5B and FIG. 7B).

As described in connection with FIG. 1104C, the derivative of the current, as measured either can be taken, for example, either using a microcontroller of the controller or by associated hardware, such as with a toroid disposed to detect the derivative of the current to the load, the output of which is in communication with a microcontroller.

In certain examples, more than one method for detecting turn off current transients can be implemented in order to detect the presence of an inductive load. For example, the amplitude of the current can be compared to a threshold and a derivative of the current can be compared to a threshold. If one or both (depending on the level of sensitivity desired) metrics are indicative of a turn off current transient, it can be determined that the load is inductive.

If, at step 1110, an inductive load is detected according to step 1108, the load can be driven in MLV mode, or any other dimming sequence designed to reduce turn off current transients at the series pass element as compared to normal operation, until the next power cycle. If, however, an inductive load is not detected, the load can be driven according to the standard pulse-width modulation sequence, as described above.

Although steps 1104-1110 are shown implemented in a single method, it should be understood that if the load is determined to be capacitive, there is no reason to continue to steps 1108 and 1110, and the method just drives the load in the normal (non-MLV) mode following the burst energization. Further, it should be understood that, in certain examples, steps 1104-1106 and 1108-1110 can be implemented independently. Thus, the method of detecting capacitive loads to determine whether to use burst energization can be implemented without also performing the steps of detecting inductive loads for determining whether to implement MLV mode dimming. Alternatively, the steps for detecting an inductive load for MLV dimming can be implemented without performing the steps for detecting capacitive load for burst energization.

In the above description of method 1100, amplitude, derivative, and integral values are described with respect to typical values of resistive, capacitive, and inductive loads during the positive half cycle of the AC mains voltage. These values are typically reversed (e.g., high positive values become low negative values and vice versa) during the negative half cycle. Thus, a person of ordinary skill in the art, in conjunction with a review of this disclosure, will understand how to implement the steps of method 1100 for characteristics measured during the negative half cycle of the AC line voltage.

Figure 11H:
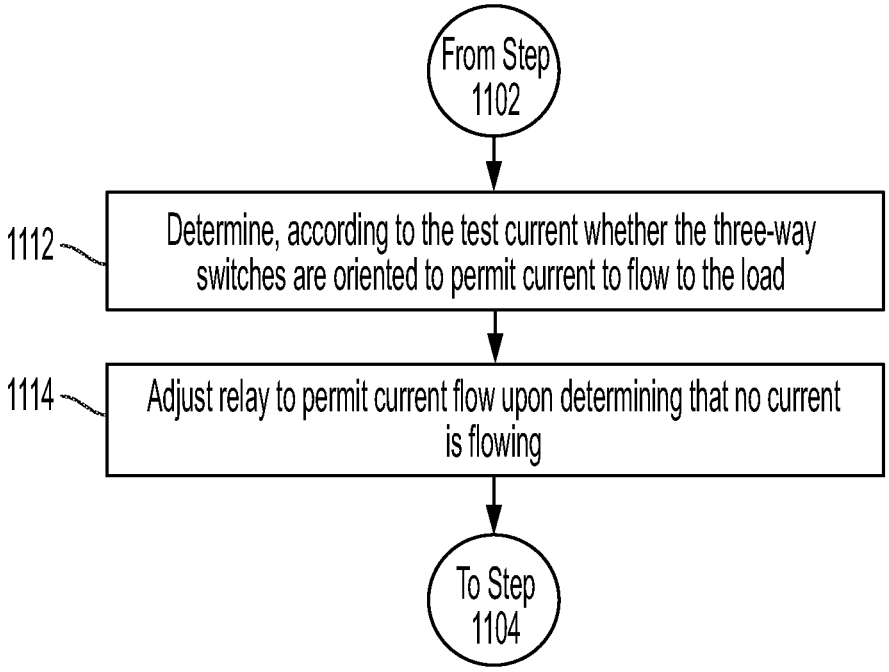
FIG. 11H is a flowchart of a method for detecting a type of load and for determining the state of a three-way wiring system, according to an example.

In addition, method 1100 can be advantageously combined with a method for determining the state of a three-way switch. A three-way switch configuration requires two switches that connect a given load (e.g., a light source) to the mains voltage by way of a pair of traveler wires, such that operation of either switch will break, or alternatively create, connection to the mains. Generally, a dimmer (e.g., dimmer 100), that is configured to determine a type of connected load, if employed in such a three-way configuration, can first use the test current step at 1102 to determine whether the switches are oriented to permit current to flow from the mains source to the load. This is shown at step 1112 of FIG. 11H, where it is determined whether the test current is flowing to the load as a result of application of the voltage that is to create the test current. If no current is flowing, then a relay of the dimmer (i.e., one of the switches of the three-way configuration) is operated to provide the voltage on the other traveler wire. The test current can be measured in any suitable way, including with a shunt resistor or a toroid. The relay can also be operated in any suitable way, e.g., with a solenoid. If the test current is detected as flowing at step 1112, no further action is required and the method proceeds to step 1104. The method of detecting the state of a three-way switch is described in further detail in US 2020/0083008A1, which is hereby incorporated by reference in its entirety.

While several inventive embodiments have been described and illustrated herein with reference to certain exemplary embodiments, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein (and it will be understood by one skilled in the art that various changes in detail may be effected therein without departing from the spirit and scope of the invention as defined by claims that can be supported by the written description and drawings). More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto; inventive embodiments may be practiced otherwise than as specifically described and claimed. Further, where exemplary embodiments are described with reference to a certain number of elements it will be understood that the exemplary embodiments can be practiced utilizing either less than or more than the certain number of elements.

All references, including publications, patent applications, and patents, cited herein are hereby incorporated by reference to the same extent as if each reference were individually and specifically indicated to be incorporated by reference and were set forth in its entirety herein.

All definitions, as defined and used herein, should be understood to control over dictionary definitions, definitions in documents incorporated by reference, and/or ordinary meanings of the defined terms.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if not directly attached to where there is something intervening.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A dimmer, comprising:

a housing assembly including a plurality of terminals at least partially disposed therein, the plurality of terminals including a line terminal, a neutral terminal, and a load terminal;

at least one variable control mechanism coupled to the housing assembly, the at least one variable control mechanism being configured to adjustably select a user adjustable load setting, the user adjustable load setting being adjustable between a minimum setting and a maximum setting;

a series pass element disposed in series the line terminal and the load terminal;

a sensor producing a sensor output representative of load current at the load terminal; and a controller configured to determine, according to a comparison of a characteristic of the load current to a metric, whether a load connected to the load terminal is a capacitive load, wherein the controller is further configured to, upon determining that the load is a capacitive load, provide sufficient power to the load sufficient to cause the load to illuminate before reducing the power the user adjusted load setting.

2. The dimmer of claim 1, wherein the characteristic is an amplitude of a peak the load current resulting from the series pass element turning on, wherein the controller is configured to compare the amplitude of the load current to a threshold.

3. The dimmer of claim 2, wherein the threshold is a fixed threshold.

4. The dimmer of claim 2, wherein the threshold is a variable threshold.

5. The dimmer of claim 2, wherein the controller comprises a comparator, the comparator being in communication with a microcontroller.

6. The dimmer of claim 1, wherein the characteristic is a derivative of the load current, wherein the controller is configured to compare the derivative to a threshold.

7. The dimmer of claim 6, wherein the derivative of the load current is taken at a point less than or equal to 2 ms following a peak of the load current resulting from the series pass element turning ON.

8. The dimmer of claim 6, wherein the derivative of the load current is taken at a point more than 2 ms following the peak of the load current resulting from the series pass element turning ON and before steady state.

9. The dimmer of claim 2, wherein the controller comprises a toroid and a microcontroller, the toroid being in communication with the microcontroller.

10. The dimmer of claim 1, wherein the characteristic is an integral of the load current taken over an interval following a peak of the load current resulting from the series pass element turning ON, wherein controller is configured to compare the integral to a threshold.

11. The dimmer of claim 10, wherein the controller comprises a toroid and a microcontroller, the toroid being in communication with the microcontroller.

12. The dimmer of claim 1, wherein the load terminal is a traveler terminal.

13. The dimmer of claim 1, wherein the controller comprises a plurality of microcontrollers.

14. The dimmer of claim 1, wherein the series pass element comprises a plurality of MOSFETs.

15. The dimmer of claim 1, wherein the controller is further configured to determine, according to a second characteristic of the load current, whether a load connected to the load terminal is an inductive load, wherein the controller is further configured to, upon determining that the load is an inductive load, to drive the load according to a dimming sequence that reduces voltage transients at the series pass element.

16. The dimmer of claim 15, wherein the second characteristic of the load current is an amplitude of a peak current resulting from turning the series pass element off, wherein the controller is configured to compare the amplitude of the load current to a threshold.

17. The dimmer of claim 16, wherein the threshold is a fixed threshold.

18. The dimmer of claim 16, wherein the threshold is a variable threshold.

19. The dimmer of claim 16, wherein the controller comprises a comparator, the comparator being in communication with a microcontroller.

20. The dimmer of claim 1, wherein the characteristic is a derivative of the load current resulting from the series pass element being turned off, wherein the controller is configured to compare the derivative to a threshold.

21. The dimmer of claim 20, wherein the controller comprises a toroid and a microcontroller, the toroid being in communication with the microcontroller.

22. A dimmer, comprising:

a housing assembly including a plurality of terminals at least partially disposed therein, the plurality of terminals including a line terminal, a neutral terminal, and a load terminal;

at least one variable control mechanism coupled to the housing assembly, the at least one variable control mechanism being configured to adjustably select a user adjustable load setting, the user adjustable load setting being adjustable between a minimum setting and a maximum setting;

a series pass element disposed in series the line terminal and the load terminal;

a sensor producing a sensor output representative of load current at the load terminal; and a controller configured to determine, according to a comparison of a characteristic of the load current to a metric, whether a load connected to the load terminal is an inductive load, wherein the controller is further configured to, upon determining that the load is an inductive load, to drive the load according to a dimming sequence that reduces voltage transients at the series pass element.

23. The dimmer of claim 22, wherein the second characteristic of the load current is an amplitude of a peak current resulting from turning the series pass element off, wherein the controller is configured to compare the amplitude of the load current to a threshold.

24. The dimmer of claim 23, wherein the threshold is a fixed threshold.

25. The dimmer of claim 23, wherein the threshold is a variable threshold.

26. The dimmer of claim 23, wherein the controller comprises a comparator, the comparator being in communication with a microcontroller.

27. The dimmer of claim 22, wherein the characteristic is a derivative of the load current resulting from the series pass element being turned off, wherein the controller is configured to compare the derivative to a threshold.

28. The dimmer of claim 27, wherein the controller comprises a toroid and a microcontroller, the toroid being in communication with the microcontroller.

29. The dimmer of claim 22, wherein the controller comprises a plurality of microcontrollers.

30. The dimmer of claim 22, wherein the series pass element comprises a plurality of MOSFETs.

* * * * *